US010111542B2

(12) United States Patent
Leung

(10) Patent No.: US 10,111,542 B2
(45) Date of Patent: Oct. 30, 2018

(54) SIMPLE HOLDER

(71) Applicant: On Shui Leung, Hong Kong (HK)

(72) Inventor: On Shui Leung, Hong Kong (HK)

( * ) Notice: Subject to any disclaimer, the term of this patent is extended or adjusted under 35 U.S.C. 154(b) by 0 days.

(21) Appl. No.: 15/506,254

(22) PCT Filed: Oct. 6, 2015

(86) PCT No.: PCT/IB2015/057626
§ 371 (c)(1),
(2) Date: Feb. 24, 2017

(87) PCT Pub. No.: WO2016/067133
PCT Pub. Date: May 6, 2016

(65) Prior Publication Data

US 2017/0295971 A1 Oct. 19, 2017

(30) Foreign Application Priority Data

Oct. 27, 2014 (HK) ..... 14110724

(51) Int. Cl.
*A47G 21/14* (2006.01)
*G09F 23/08* (2006.01)
(Continued)

(52) U.S. Cl.
CPC ..... *A47G 21/145* (2013.01); *A47G 21/14* (2013.01); *G09F 3/04* (2013.01); *G09F 23/08* (2013.01);
(Continued)

(58) Field of Classification Search
CPC ..... A47G 21/145; A47G 2021/002; B65D 85/20; A47J 47/16
USPC ..... 248/346.3, 37.3, 37.6, 174; 220/500; 40/642.02; 229/103; 211/70.1, 70.7; 206/443
See application file for complete search history.

(56) References Cited

U.S. PATENT DOCUMENTS 598,028 A * 1/1898 Smith et al. ..... A47F 5/112 131/257
1,053,126 A * 2/1913 Fuller et al. ..... F16M 11/04 131/257
(Continued)

FOREIGN PATENT DOCUMENTS

CN 2123940 U 12/1992
DE 202004008979 U1 12/2004

OTHER PUBLICATIONS

International Search Report of PCT Patent Application No. PCT/IB2015/057626 dated Jan. 18, 2016.

*Primary Examiner* — Nkeisha Smith

(57) ABSTRACT

The present invention relates to a simple holder which includes an elastic first sheet structure. The first sheet structure has a first side and a second side which are opposite to each other, a hole located between the first side and the second side, a first cutting slit formed by cutting from the edge of the first side inwards, and a second cutting slit formed by cutting from the edge of the second side inwards. The center of the hole is located between the first cutting slit and the second cutting slit. The first sheet structure can be bent to make the first cutting slit slotting into the second cutting slit for locking. The simple holder provided by the present invention is formed by sheets and is thus convenient to be manufactured, transported and stored.

16 Claims, 5 Drawing Sheets

(51) Int. Cl.
*G09F 3/04* (2006.01)
*A47G 21/00* (2006.01)
*A47G 19/22* (2006.01)

(52) U.S. Cl.
CPC .... *A47G 19/2227* (2013.01); *A47G 2021/002* (2013.01)

(56) References Cited

U.S. PATENT DOCUMENTS 1,172,667 A * 2/1916 Bunnell ..... A47F 5/112 211/85.4
2,295,242 A * 9/1942 Slingsby ..... B65D 75/522 206/380
2,511,542 A * 6/1950 Rau ..... B65D 5/504 206/553
2,528,016 A * 10/1950 Smith ..... B65D 75/54 229/120.22
2,639,081 A * 5/1953 Metzger ..... B65D 5/504 206/488
2,664,005 A * 12/1953 Kosinski ..... A47J 47/16 126/221
2,708,085 A * 5/1955 Bonaccorsi ..... B65D 5/04 248/174
2,807,361 A * 9/1957 Junkin ..... B65D 5/504 206/553
2,980,241 A * 4/1961 Howell, Jr. ..... B65D 5/504 206/553
3,263,820 A * 8/1966 McFadden ..... A61M 5/008 211/60.1
4,573,570 A * 3/1986 Cortopassi ..... A47G 19/30 229/938
4,671,404 A * 6/1987 Wall ..... A47G 21/001 206/45.24
4,770,379 A * 9/1988 Estvold ..... A47K 1/09 211/65
4,834,328 A * 5/1989 Hall ..... A47G 21/14 248/174
4,905,947 A * 3/1990 Henne ..... A47F 5/112 248/152
4,940,199 A * 7/1990 Hall ..... A47G 21/14 248/174
5,079,803 A * 1/1992 Moore ..... B65D 63/1018 24/16 R
D336,014 S * 6/1993 Castro ..... D7/504
5,249,380 A * 10/1993 Fast ..... F17C 13/003 40/306
5,785,238 A * 7/1998 Tai ..... A47G 21/14 206/443
6,273,278 B1 * 8/2001 Enyedy ..... A47F 7/0028 211/73
D527,841 S * 9/2006 Schorkmayr ..... D27/183
D779,271 S * 2/2017 Simon ..... D7/504
2010/0206997 A1 * 8/2010 Starke ..... A47G 21/14 248/37.3

* cited by examiner

SIMPLE HOLDER

FIELD OF INVENTION

The present invention relates to the field of tableware, in particular to a simple holder.

BACKGROUND

Tableware, such as chopsticks, knives and forks are the common eating tableware used during meals. Sometimes, people may need to temporarily put down the tableware during the course of meals. For hygiene's sake, a simple stand is used to hold the tableware so that the head thereof is kept off the table and to prevent it from contaminating or rolling off tables. Such simple stands are vastly used in restaurants or at home and most of them available in the market are made in solid shapes with either ceramic, metal or wood. These particular simple stands generally include a recess for resting the head of the tableware. Whereas, in order to ensure the stability, these simple stands usually come with certain thickness and the process of making the same is relatively complex. In addition, all these simple stands need to be washed after use and thus lead to waste of resources. Moreover, these simple stands occupy certain storage space.

Therefore, a simple holder, which is simple in its manufacturing process and is space-saving and, last but not least, has an added value for advertisement or promotional purpose, is desired.

SUMMARY OF INVENTION

The objective of the present invention is aimed to provide a simple holder which is simple in its manufacturing process, convenient in storage, space-saving and to serve as an advertisement or promotional media. The simple holder comprises an elastic first sheet structure. The first sheet structure has two opposite sides, namely, a first side and a second side. A hole located between the first side and the second side, a first cutting slit formed by cutting from the edge of the first side inwards and a second cutting slit formed by cutting from the edge of the second side inwards. The center of the hole is located between the first cutting slit and the second cutting slit. The first sheet structure can be bent to make the first cutting slit slotting into the second cutting slit and thus interlocked. Under this state, a part of the first sheet structure, which is located between the first cutting slit and the second cutting slit, is bent and rolled into a cylinder, and a part of the first sheet structure, which contains the hole, is also bent and rolled into a groove for placing articles.

As a preferred embodiment, the first side is parallel to the second side.

As a preferred embodiment, the first cutting slit extends to the middle position of both the first side and the second side, and the second cutting slit extends to the middle position of the first side and the second side.

As a preferred embodiment, the direction of the first cutting slit is perpendicular to that of the first side, and the direction of the second cutting slit is perpendicular to that of the second side.

As a preferred embodiment, the length of the hole is ⅓ of the overall length of the first sheet structure.

As a preferred embodiment, the first sheet structure comprises at least two holes which are disposed abreast between the first side and the second side. When a part of the first sheet structure, which is located between the first cutting slit and the second cutting slit, is bent and rolled into a cylinder, a part of the first sheet structure, which contains at least two holes, is bent and rolled to form at least two grooves for placing articles.

As a preferred embodiment, the hole is a runway-like U-shaped hole including two parallel opposite sides and two opposite arc-shaped sides.

As a preferred embodiment, the distance between the first cutting slit and the second cutting slit is ½ to ⅔ of the overall length of the first sheet structure.

As a preferred embodiment, the simple holder also comprises a second sheet structure which is connected with the second side of the first sheet structure. The second sheet structure can be overturned for multiple times to form a storage cavity having an open end for storing articles. The connection between the second sheet structure and the first sheet structure is a tearing connection which can be torn along the second side.

As a preferred embodiment, the length of the first side and the second side ranges from 100 mm to 200 mm, and the width of the first side and the second side ranges from 25 mm to 70 mm.

As a preferred embodiment, both ends of the first sheet structure are have a first slot and a second slot respectively. After the first sheet structure is bent, the first slot and the second slot can be penetrated by a first reinforcing sheet.

As a preferred embodiment, the first reinforcing sheet is positioned between the end portion of the first sheet structure and the part which is bent and rolled into a cylinder.

As a preferred embodiment, the first reinforcing sheet is slightly tight fit with the first slot and the second slot.

As a preferred embodiment, the shape of the first reinforcing sheet is the same as that of the hole.

As a preferred embodiment, the first reinforcing sheet and the first sheet structure are a single body before use, and the hole is formed in the first sheet structure after the first reinforcing sheet is torn off.

As a preferred embodiment, the first reinforcing sheet is bent at both ends after penetrating through the first slot and the second slot so as to prevent the first sheet structure from departing from the first reinforcing sheet.

The simple holder provided by the present invention is formed by sheets and is thus convenient to be manufactured, transported and stored. The sheets can be bent, rolled and shaped as a holder.

DETAILED DESCRIPTION OF PREFERRED EMBODIMENTS

The embodiments of the present invention are further illustrated as below in conjunction with the drawings.

Figure 1:
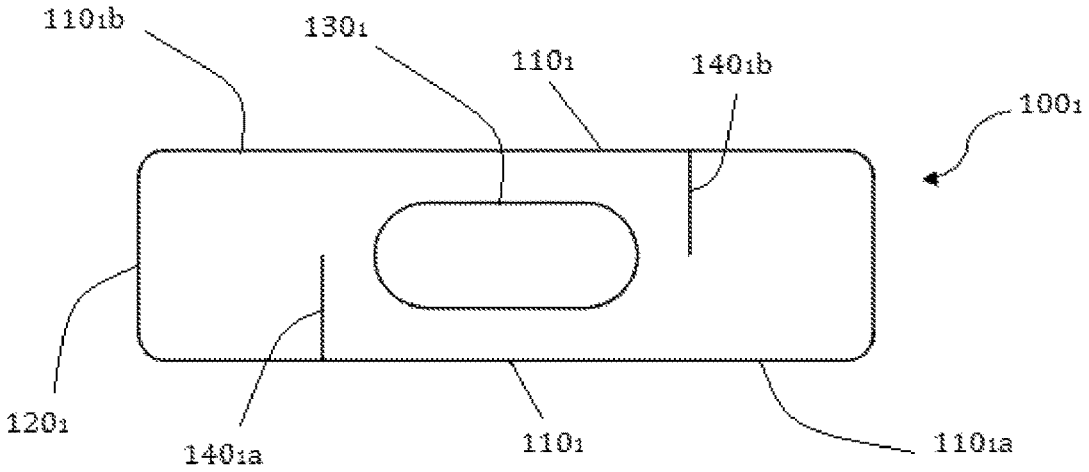
FIG. 1 is a structural schematic diagram of the simple holder at an unused state.

Referring to FIG. 1, the simple holder of the first embodiment of the present invention comprises a first sheet structure $\mathbf{100}_1$ which is rectangular and has a lateral side $\mathbf{110}_1$ and a shorter side $\mathbf{120}_1$. The lateral side $\mathbf{110}_1$ comprises a first side $\mathbf{110}_1$a and a second side $\mathbf{110}_1$b which are parallel to each other. There is at least one hole $\mathbf{130}_1$ between the first side $\mathbf{110}_1a$ and the second side $\mathbf{110}_1b$. In this embodiment, there is one hole $\mathbf{130}_1$ and the center of the hole $\mathbf{130}_1$ is located between a first cutting slit $\mathbf{140}_1a$ and a second cutting slit $\mathbf{140}_1b$. In this embodiment, the hole $\mathbf{130}_1$ is a runway-like U-shaped hole including two basically parallel opposite sides and two opposite arc-shaped sides. The extending direction of the hole $\mathbf{130}_1$ is the same as that of the lateral side $\mathbf{110}_1$. The hole $\mathbf{130}_1$ is axially symmetrical to the central axis of the lateral side $\mathbf{110}_1$, and the length of the U-shaped hole is around ⅓ of the lateral side $\mathbf{110}_1$ of the first sheet structure $\mathbf{100}_1$. The width of the hole $\mathbf{130}_1$ is about 12 mm-20 mm. The shape of the tail ends of the hole $\mathbf{130}_1$ can be varied, such as n-shape or 3-shape based on needs. Similarly, the hole $\mathbf{130}_1$ may not be a U-shaped hole and can be circular, elliptical, rectangular and the like. All the variations mentioned above fall within the protection scope of the present invention. The first cutting slit $\mathbf{140}_1a$ is formed by cutting from the edge of the first side $\mathbf{110}_1a$ inwards, and the second cutting slit $\mathbf{140}_1b$ is formed by cutting from the edge of the second side $\mathbf{110}_1b$ inwards. The first cutting slit $\mathbf{140}_1a$ and the second cutting slit $\mathbf{140}_1b$ are respectively located in two sides of the hole $\mathbf{130}_1$. The distance between the first cutting slit $\mathbf{140}_1a$ and the second cutting slit $\mathbf{140}_1b$ is ½ to ⅔ of the overall length of the first sheet structure $\mathbf{100}_1$. In this embodiment, the direction of the first cutting slit $\mathbf{140}_1a$ is perpendicular to that of the first side $\mathbf{110}_1a$, and the direction of the second cutting slit $\mathbf{140}_1b$ is perpendicular to that of the second side $\mathbf{110}_1b$. The sum of the length of the first cutting slit $\mathbf{140}_1a$ and the length of the second cutting slit $\mathbf{140}_1b$ should be larger than or equal to the length of the shorter side $\mathbf{120}_1$. In this embodiment, the lengths of the first cutting slit $\mathbf{140}_1a$ and the second cutting slit $\mathbf{140}_1b$ are ½ of the length of the shorter side $\mathbf{120}_1$, i.e. the first cutting slit $\mathbf{140}_1a$ extends to the middle position of the first side $\mathbf{110}_1a$ and the second side $\mathbf{110}_1b$, and the second cutting slit $\mathbf{140}_1b$ extends to the middle position of the first side $\mathbf{110}_1a$ and the second side $\mathbf{110}_1b$. In addition, the distance between the first cutting slit $\mathbf{140}_1a$ and the central axis of the lateral side $\mathbf{110}_1$ equals to the distance between the second cutting slit $\mathbf{140}_1b$ and the central axis of the lateral side $\mathbf{110}_1$. The distance between the first cutting slit $\mathbf{140}_1a$ and the nearer shorter side $\mathbf{120}_1$ is ⅓ to ¼ of the length of the lateral side.

Figure 2:
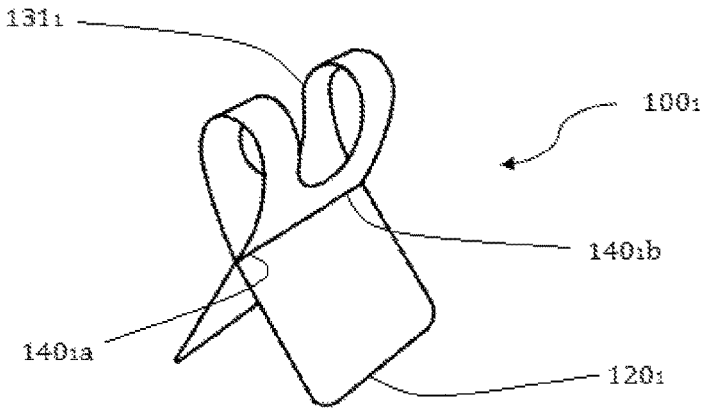
FIG. 2 is a schematic diagram of the simple holder of FIG. 1 at a used state.
Figure 3:
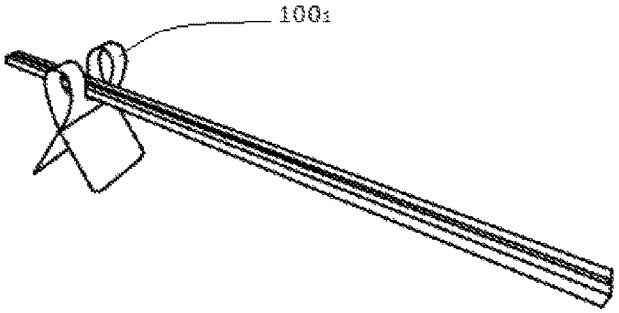
FIG. 3 is a schematic diagram of a using method of the simple holder of FIG. 1.

Referring to FIG. 2 and FIG. 3, when the first sheet structure $\mathbf{100}_1$ is in use, the first cutting slit $\mathbf{140}_1a$ is clamped into the second cutting slit $\mathbf{140}_1b$ for locking, i.e. the first cutting slit $\mathbf{140}_1a$ and the second cutting slit $\mathbf{140}_1b$ are located on the same straight line at this moment. When the first sheet structure $\mathbf{100}_1$ is bent, the hole $\mathbf{130}_1$ forms a groove $\mathbf{131}_1$ for containing tableware such as chopsticks or knives and forks, and the shorter side $\mathbf{120}_1$ is used to be placed on a dining table.

Figure 4:
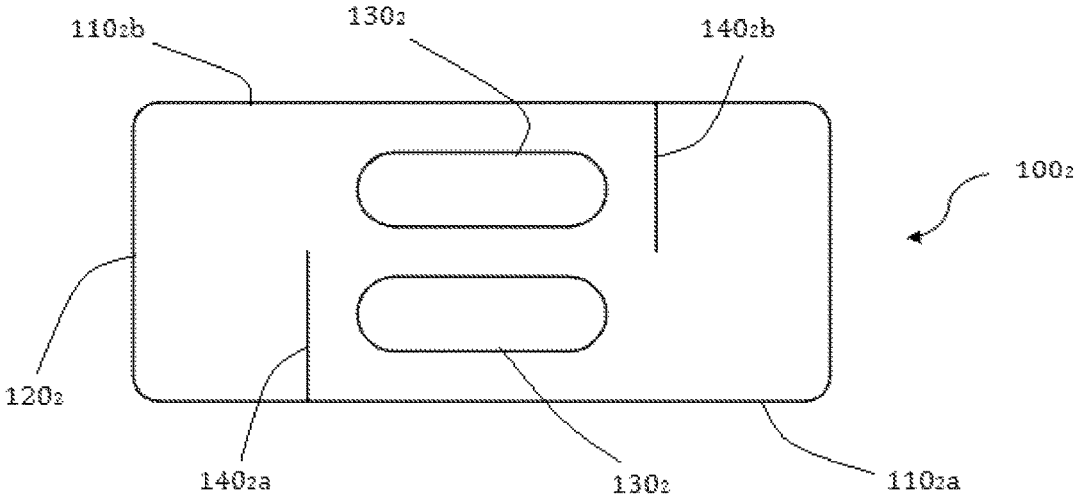
FIG. 4 is a schematic diagram of the simple holder of a second embodiment of the present invention at an unused state.
Figure 5:
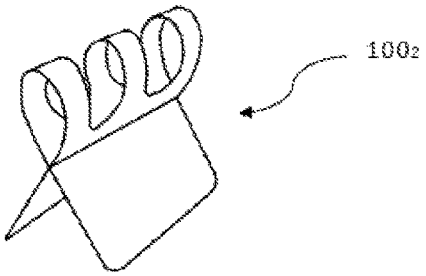
FIG. 5 is a schematic diagram of the simple holder of FIG. 4 at a used state.
Figure 6:
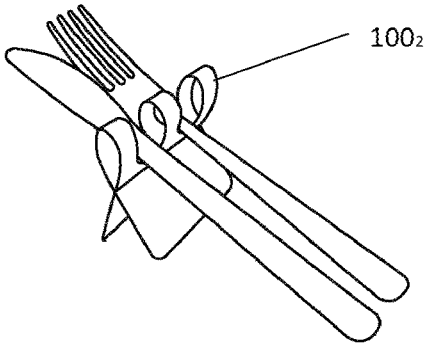
FIG. 6 is a schematic diagram of a using method of the simple holder of FIG. 4.

Referring to FIG. 4 to FIG. 6, the difference between the simple holder of the third embodiment and the simple holder of the first embodiment lies in that the first sheet structure $\mathbf{100}_2$ has at least two holes $\mathbf{130}_2$ along the central axis of the longer side of a first sheet structure $\mathbf{100}_2$. The two holes $\mathbf{130}_2$ are located abreast between the first side edge $\mathbf{110}_2a$ and the second side edge $\mathbf{110}_2b$. In particular, the holes $\mathbf{130}_2$ are uniformly arranged on the connection line of midpoints of the first side edge $\mathbf{110}_2a$ and the second side edge $\mathbf{110}_2b$. The spacing distance between the holes $\mathbf{130}_2$ is about ⅔ of the width of each hole $\mathbf{130}_2$. A part of the first sheet structure, which is located between the first cutting slit $\mathbf{140}_2a$ and the second cutting slit $\mathbf{140}_2b$, is bent into a cylinder, and then a part of the first sheet structure, which contains the two holes $\mathbf{130}_2$, is also bent and rolled into two grooves on which two pairs of chopsticks or other tableware, such as knives and forks (as shown in FIG. 6), can be simultaneously placed.

Figure 7:
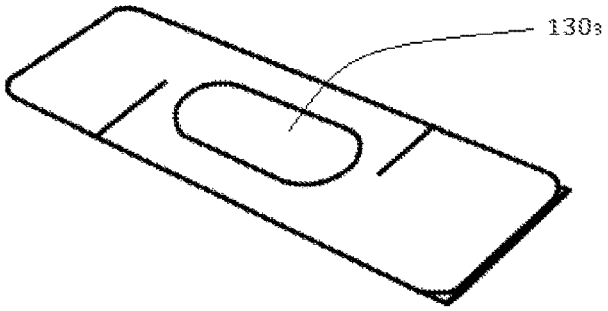
FIG. 7 is a stereogram of the simple holder with a tableware sleeve of the third embodiment of the present invention.
Figure 8:
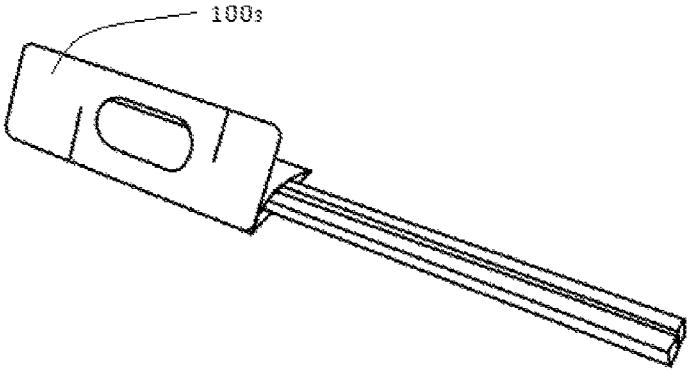
FIG. 8 is a reference diagram of the simple holder with the tableware sleeve of FIG. 7 in a used state.
Figure 9:
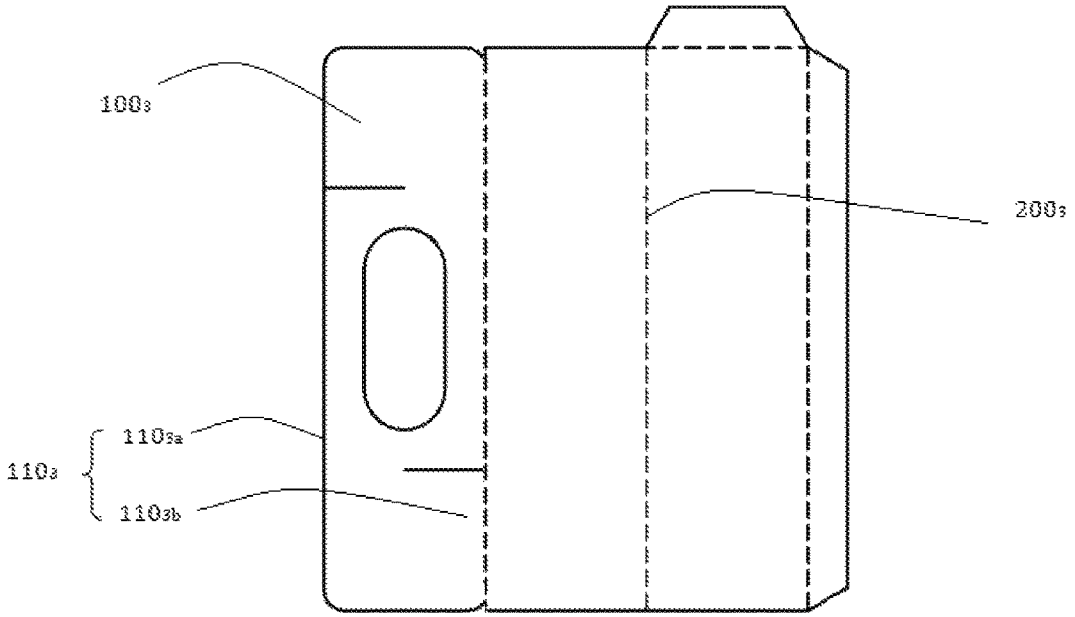
FIG. 9 is a plane expanded drawing of the simple holder with the tableware sleeve of FIG. 7.

Referring to FIG. 7 to FIG. 9, the simple holder of the third embodiment of the present invention comprises a first sheet structure $\mathbf{100}_3$ and a second sheet structure $\mathbf{200}_3$. The simple holder provided by the present invention is preferred to be made of paper, thin plastic or other elastic materials. The connection between the first sheet structure $\mathbf{100}_3$ and the second sheet structure $\mathbf{200}_3$ is a tearing connection. The second sheet structure $\mathbf{200}_3$ is overturned to make the free end of the first sheet structure $\mathbf{100}_3$ be overlapped with the first sheet structure $\mathbf{100}_3$ to form a cavity having an open end for replacing the tableware sleeve to cover tableware in a connecting state, so that materials can be saved. When it is used as a simple holder, the first sheet structure $\mathbf{100}_3$ needs to be separated from the second sheet structure $\mathbf{200}_3$. When the simple holder is made of materials such as paper or plastic, it just needs to be manually torn apart. As a preferred embodiment, the simple holder is made of recycled paper or environment-friendly plastic. Patterns or advertisement information can be printed on both sides (i.e. the region between the shorter side and the first cutting slit or the second cutting slit) of the first sheet structure $\mathbf{100}_3$, and patterns or advertisement information can be printed on both surfaces of the first sheet structure. The simple holder is disposable and thus it is not necessary to be washed, and it is environment-friendly and attractive in appearance, and also it can achieves an advertisement or promotion effect. Another advantage of the preset invention is that it is easy to be stored without occupying a large space since it is a sheet structure in an unused state.

Figure 10:
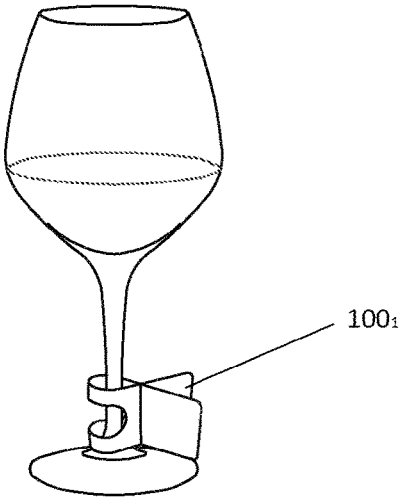
FIG. 10 is a reference diagram of the simple holder of FIG. 1 used as an identification tag.

As shown in FIG. 10, the simple holder as mentioned above can also be used as an identification tag and is thus applicable to crowded occasions, such as wine parties and dinner parties. The identification tag can be sheathed on a handle of a wine cup or a cup, and a user can write down the name for the purpose of facilitating identification.

Figure 11:
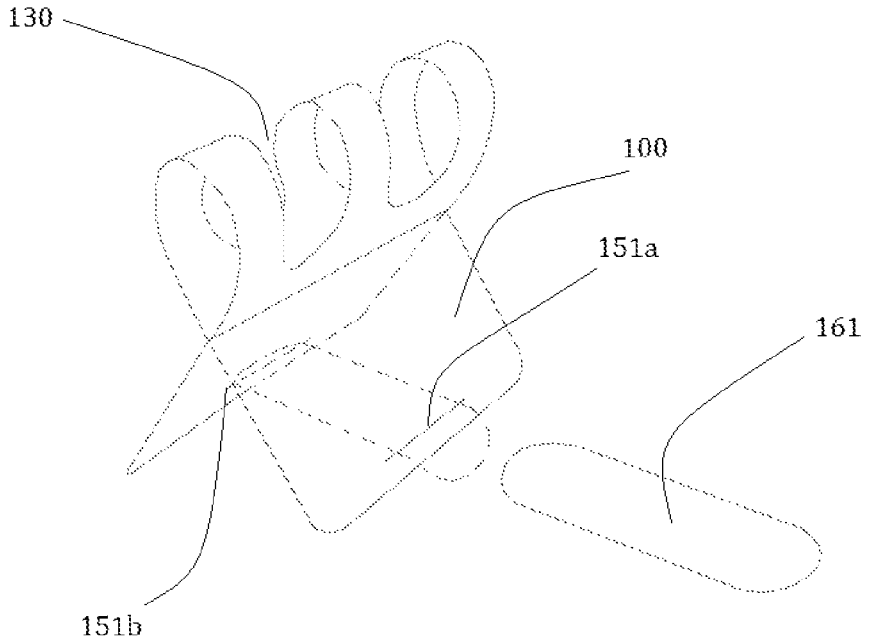
FIG. 11 is a reference diagram of the simple holder of a fourth embodiment of the present invention at a used state.
Figure 12:
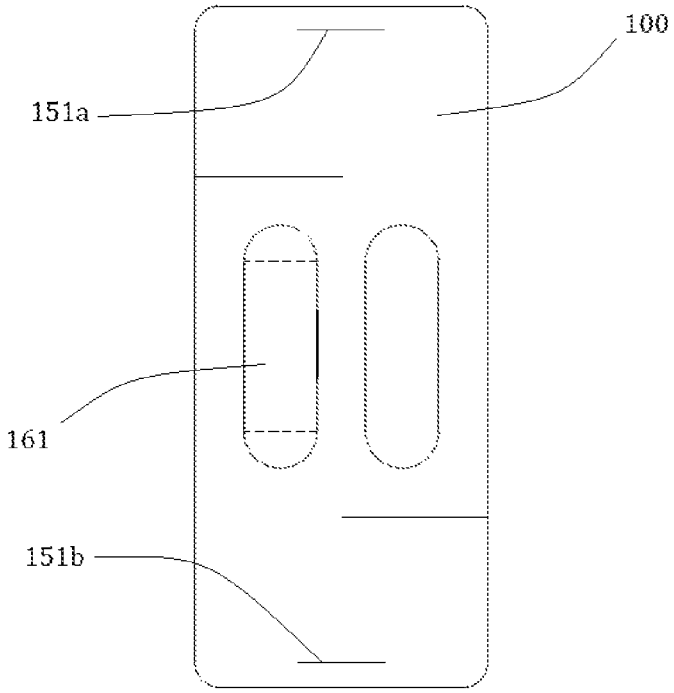
FIG. 12 is schematic diagram of the simple holder of FIG. 11 in an unused state.

By reference to FIG. 11 and FIG. 12, in the simple holder of the fourth embodiment of the present invention, both ends of the hole 130 of the first sheet structure 100 have a first slot 151*a* and a second slot 151*b* respectively. After the first sheet structure is bent, the first slot 151*a* and the second slot 151*b* can be penetrated by the first reinforcing sheet 161. At this moment, the first reinforcing sheet 161 is positioned between the end portion of the first sheet structure and the part which is bent and rolled into a cylinder. Preferably, the first reinforcing sheet is in slightly tight fit with the first slot and the second slot so as to prevent the first sheet structure from departing from the first reinforcing sheet 161, and thus the supporting capability of the simple holder is enhanced. Further, the first reinforcing sheet 161 is bent at both ends after penetrating through the first slot 151*a* and the second slot 151*b* for further preventing the first sheet structure from departing from the first reinforcing sheet, and thus the supporting capability of the simple holder is further enhanced.

In one embodiment, the shape of the first reinforcing sheet 161 is the same as that of the hole 130. Preferably, the first reinforcing sheet 161 and the first sheet structure 100 are a single body before use, and the hole 130 is formed in the first sheet structure after the first reinforcing sheet 161 is torn off.

In another embodiment, the first reinforcing sheet 161 and the first sheet structure 100 can be two different single body. In addition, each first sheet structure 100 may have two or more pairs of slots.

For the simple holder as described above, the lengths of the first side and the second side of the first sheet structure can be set as 100 mm to 200 mm, whereas the width of the first sheet structure, i.e. the distance between the first side and the second side, can be set as 25 mm to 70 mm.

The embodiments mentioned above just describe several implementations of the present invention. The descriptions thereof are concrete and detailed, but may not hereby be interpreted as limitations to the protection scope of the present invention. It should be noted that transformations and improvements may be made to the present invention by the persons of ordinary skills in the art but these transformations and improvements should still fall within the protection scope of the present invention. Therefore, the protection scope of the present invention is defined by the claims.

What is claimed is:

1. A simple holder comprising an elastic first sheet structure, wherein said first sheet structure comprises:

a first side;

a second side opposite to said first side;

a hole located between said first side and said second side;

a first cutting slit formed by cutting from the edge of said first side inwards; and a second cutting slit formed by cutting from the edge of said second side inwards;

a center of said hole being located between said first cutting slit and said second cutting slit;

wherein said first sheet structure can be bent to make said first cutting slit slotting into said second cutting slit and thus interlocked, and under this state, a part of said first sheet structure, which is located between said first cutting slit and said second cutting slit, is bent and rolled into a cylinder, and a part of said first sheet structure, which contains said hole, is bent and rolled to form a groove for placing articles;

and wherein both ends of said first sheet structure have a first slot and a second slot respectively, and after said first sheet structure is bent, said first slot and said second slot can be penetrated by a first reinforcing sheet;

and wherein said first reinforcing sheet has a same shape as that of said hole.

2. The simple holder according to claim 1, wherein said first side is parallel to said second side.

3. The simple holder according to claim 1, wherein said first cutting slit extends to a middle position of both said first side and said second side, and said second cutting slit extends to the middle position of said first side and said second side.

4. The simple holder according to claim 1, wherein a direction of said first cutting slit is perpendicular to that of said first side, and a direction of said second cutting slit is perpendicular to that of said second side.

5. The simple holder according to claim 1, wherein length of said hole is ⅓ of overall length of said first sheet structure.

6. The simple holder according to claim 1, wherein said first sheet structure comprises at least two said holes, said at least two holes being disposed abreast between said first side and said second side; when said part of said first sheet structure, which is located between said first cutting slit and said second cutting slit, is bent and rolled into a cylinder, said part of said first sheet structure, which contains said at least two holes, is bent and rolled to form at least two grooves for placing articles.

7. The simple holder according to claim 6, wherein length of said first side and said second side ranges from 100 mm to 200 mm, and width of said first side and said second side ranges from 25 mm to 70 mm.

8. The simple holder according to claim 1, wherein said hole is a runway-shaped hole including two parallel opposite sides, and two opposite arc-shaped sides, each of which is represented as a "U".

9. The simple holder according to claim 1, wherein distance between said first cutting slit and said second cutting slit is ½ to ⅔ of overall length of said first sheet structure.

10. The simple holder according to claim 1 further comprising a second sheet structure connected with said second side of said first sheet structure, wherein said second sheet structure can be overturned for multiple times to form a storage cavity having an open end for storing articles; connection between said second sheet structure and said first sheet structure being a tearing connection which can be torn along said second side.

11. The simple holder according to claim 10, wherein length of said first side and said second side ranges from 100 mm to 200 mm, and width of said first side and said second side ranges from 25 mm to 70 mm.

12. The simple holder according to claim 1, wherein length of said first side and said second side ranges from 100 mm to 200 mm, and width of said first side and said second side ranges from 25 mm to 70 mm.

13. The simple holder according to claim 1, wherein said first reinforcing sheet is positioned between end portion of said first sheet structure and said part which is bent and rolled into a cylinder.

14. The simple holder according to claim 1, wherein said first reinforcing sheet is in slightly tight fit with said first slot and said second slot.

15. The simple holder according to claim 1, wherein said first reinforcing sheet and said first sheet structure are a single body before use, said hole being formed in the said first sheet structure after said first reinforcing sheet is torn off.

16. The simple holder according to claim 1, wherein said first reinforcing sheet is bent at both ends after penetrating through said first slot and said second slot so as to prevent said first sheet structure from departing from said first reinforcing sheet.

* * * * *